US005427385A

United States Patent [19]

Conrad et al.

[11] Patent Number: 5,427,385

[45] Date of Patent: Jun. 27, 1995

[54] FLETCH REPLACEMENT DEVICE

[76] Inventors: Phillip J. Conrad; Michael P. Conrad, both of 914 Alison Ave., Mechanicsburg, Pa. 17055

[21] Appl. No.: 322,472

[22] Filed: Oct. 17, 1994

[51] Int. Cl.[6] ..... F42B 6/06

[52] U.S. Cl. ..... 273/423

[58] Field of Search ..... 273/423, 420

[56] References Cited

U.S. PATENT DOCUMENTS

| | | | |
|---|---|---|---|
| 1,748,200 | 2/1930 | Barngart | 273/423 |
| 1,842,540 | 1/1932 | Cowdery | 273/423 |
| 2,292,016 | 2/1960 | Neal et al. | 273/423 |
| 3,895,802 | 7/1975 | Bear | 273/423 |
| 3,923,310 | 12/1975 | Lowy | 273/423 |

FOREIGN PATENT DOCUMENTS

| | | | |
|---|---|---|---|
| 272658 | 6/1927 | United Kingdom | 273/423 |
| 608736 | 9/1948 | United Kingdom | 273/423 |

*Primary Examiner*—Paul E. Shapiro

[57] ABSTRACT

A new and improved fletch replacement device with a securement portion having an adhesive surface thereon. The adhesive surface is adapted to be coupled with an upper end of a shaft of the arrow. The securement portion has a plurality of slots integral therewith. The plurality of slots have a gap of about ¼ of an inch therebetween. A fletch portion has a flange integral therewith. The flange is slidably coupled with the plurality of slots of the securement portion.

4 Claims, 4 Drawing Sheets

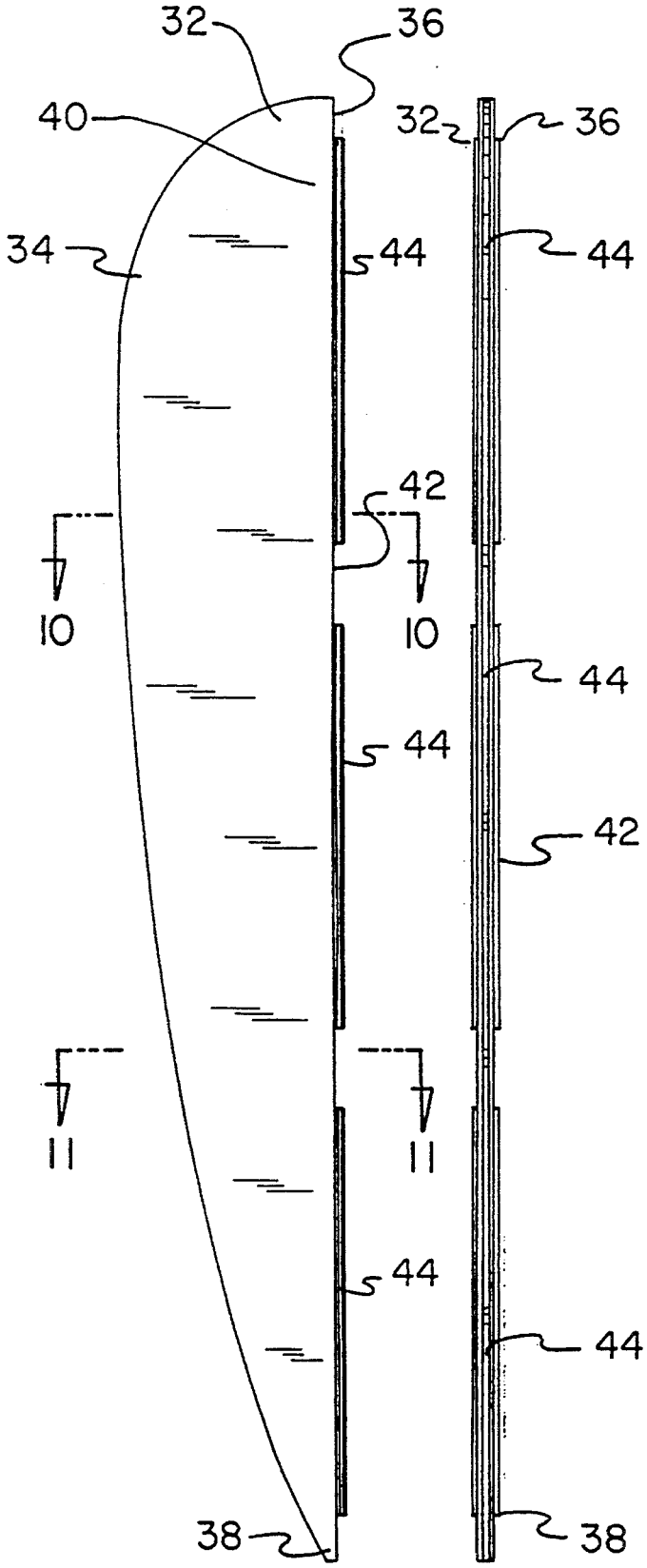
FIG. 8
FIG. 9
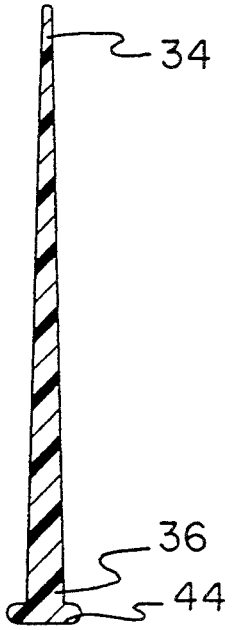
FIG. 10
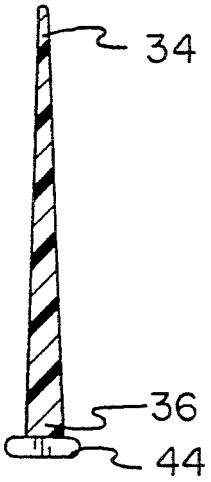
FIG. 11

FLETCH REPLACEMENT DEVICE

BACKGROUND OF THE INVENTION

1. Field of the Invention

The present invention relates to a fletch replacement device and more particularly pertains to changing or replacing fletches on arrows quickly and easily with a fletch replacement device.

2. Description of the Prior Art

The use of fletching devices is known in the prior art. More specifically, fletching devices heretofore devised and utilized for the purpose of supporting a fletch on an arrow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,211,382 to Finlay discloses an arrow fletcher.

U.S. Pat. No. 5,061,008 to Saunders discloses a fixture for arrow nock and fletching orientation.

U.S. Pat. No. 4,392,654 to Carella discloses arrow fletching.

U.S. Pat. No. 4,138,113 to Sheldon, Jr. discloses a dart fletching assembly.

U.S. Pat. No. 3,815,916 to Meszaros discloses a fletching unit for arrow.

While these devices fulfill their respective, particular objective and requirements, the aforementioned patents do not describe a fletch replacement device for changing or replacing fletches on arrows quickly and easily.

In this respect, the fletch replacement device according to the present invention substantially departs from the conventional concepts and designs of the prior art, and in doing so provides an apparatus primarily developed for the purpose of changing or replacing fletches on arrows quickly and easily.

Therefore, it can be appreciated that there exists a continuing need for a new and improved fletch replacement device which can be used for changing or replacing fletches on arrows quickly and easily. In this regard, the present invention substantially fulfills this need.

SUMMARY OF THE INVENTION

In the view of the foregoing disadvantages inherent in the known types of fletching devices now present in the prior art, the present invention provides an improved fletch replacement device. As such, the general purpose of the present invention, which will be described subsequently in greater detail, is to provide a new and improved fletch replacement device and method which has all the advantages of the prior art and none of the disadvantages.

To attain this, the present invention essentially comprises a securement portion having an upper surface, a lower surface, a first end, a second end, and an intermediate extent therebetween. The lower surface has an adhesive surface thereon. The adhesive surface is adapted to be coupled with an upper end of a shaft of the arrow. The upper surface of the first end has a slot integral therewith inwardly thereof. The upper surface of the intermediate extent has a slot integral therewith. The upper surface of the second end has a slot integral therewith inwardly thereof. The slot of the first end and the slot of the second end and the slot of the intermediate extent have a gap of about $\frac{1}{4}$ of an inch therebetween. A securement tab is secured to the upper surface inward of the first end. The device contains an adhesive cover. The adhesive cover is removably secured to the adhesive surface of the securement portion. The adhesive cover serves to protect the adhesive surface before being coupled with the upper end of the shaft of the arrow. The device contains a fletch portion having an upper surface, a lower surface, a first end, a second end, and an intermediate extent therebetween. The lower surface of the first end has a flange integral therewith. The lower surface of the second end has a flange integral therewith. The lower surface of the intermediate extent has a flange integral therewith. The flange of the first end is slidably coupled with the slot of the second end of the securement portion. The flange of the second end is slidably coupled with the slot of the first end of the securement portion. The flange of the intermediate extent is slidably coupled with the slot of the intermediate extent of the securement portion. The fletch portion is prevented from sliding out of the securement portion by the securement tab.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basic for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fletch replacement device which has all the advantages of the prior art fletching devices and none of the disadvantages.

It is another object of the present invention to provide a new and improved fletch replacement device which may be easily and efficiently manufactured and marketed.

It is a further object of the present invention to provide a new and improved fletch replacement device which is of durable and reliable construction.

An even further object of the present invention is to provide a new and improved fletch replacement device which is susceptible of a low cost of manufacture with regard to both materials and labor, and which accordingly is then susceptible of low prices of sale to the consuming public, thereby making such a fletch replacement device economically available to the buying public.

Still yet another object of the present invention is to provide a new and improved fletch replacement device which provides in the apparatuses and methods of the prior art some of the advantages thereof, while simultaneously overcoming some of the disadvantages normally associated therewith.

Even still another object of the present invention is to provide a new and improved fletch replacement device for changing or replacing fletches on arrows quickly and easily.

Lastly, it is an object of the present invention to provide a new and improved fletch replacement device with a securement portion having an adhesive surface thereon. The adhesive surface is adapted to be coupled with an upper end of a shaft of the arrow. The securement portion has a plurality of slots integral therewith. The plurality of slots have a gap of about ¼ of an inch therebetween. A fletch portion has a flange integral therewith. The flange is slidably coupled with the plurality of slots of the securement portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a side elevated view of the fletch portion of the present invention.

FIG. 9 is a bottom view of the fletch portion of the present invention.

FIG. 10 is a cross-sectional view taken along line 10—10 of FIG. 8.

FIG. 11 is a cross-sectional view taken along line 11—11 of FIG. 8.

The same reference numerals refer to the same parts through the various Figures.

DESCRIPTION OF THE PREFERRED EMBODIMENT

Figure 2:
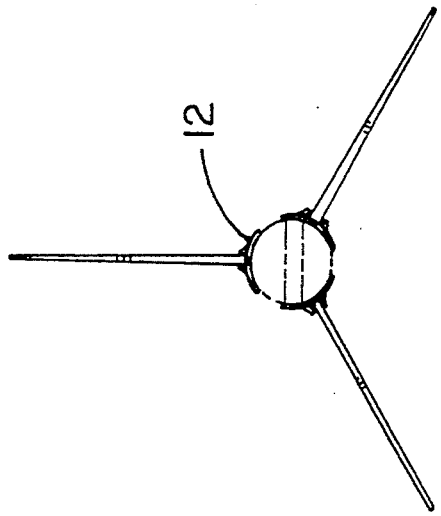
FIG. 2 is a rearward elevated view of the present invention.
Figure 1:
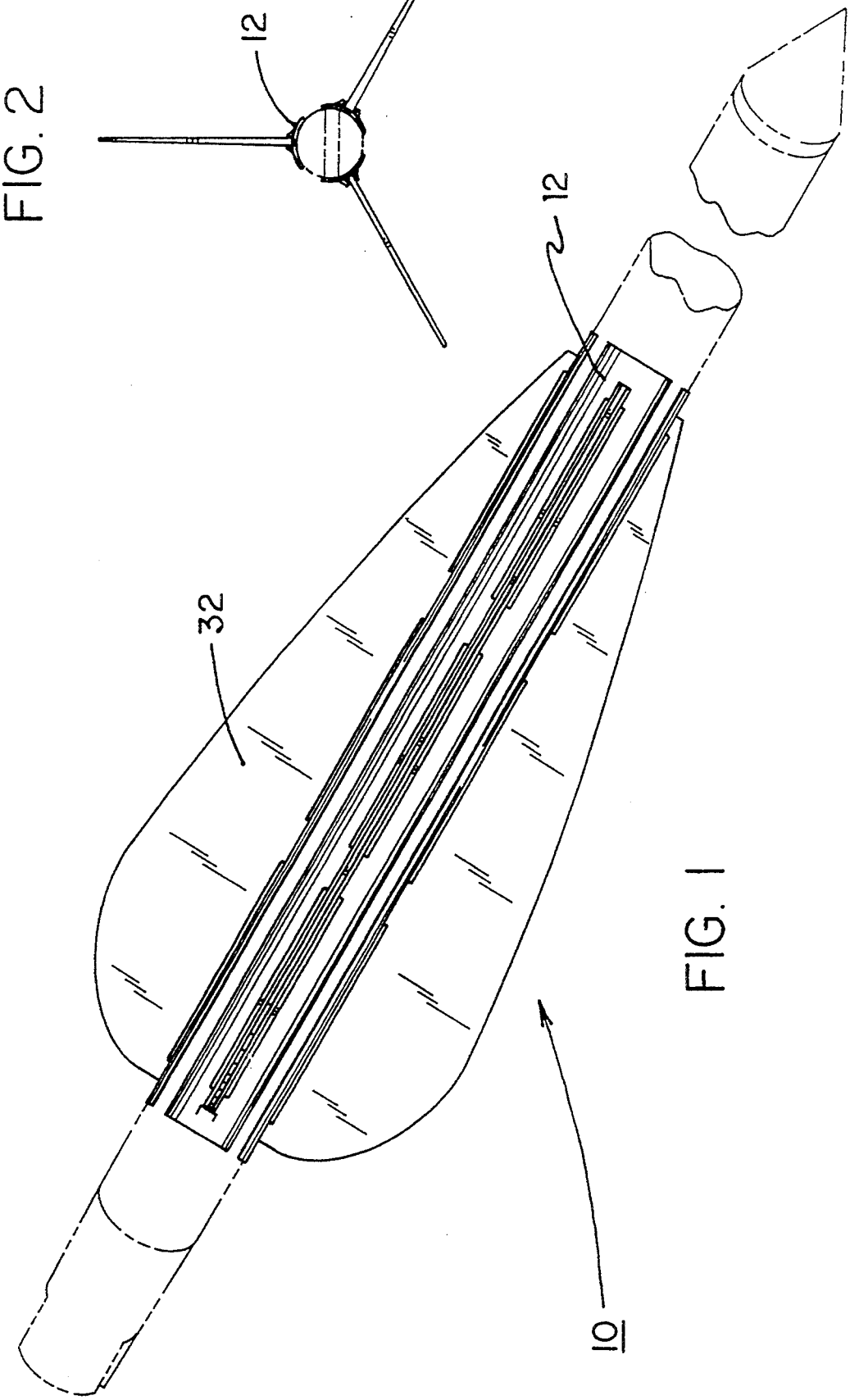
FIG. 1 is a perspective view of the preferred embodiment of the fletch replacement device constructed in accordance with the principles of the present invention.
Figure 3:
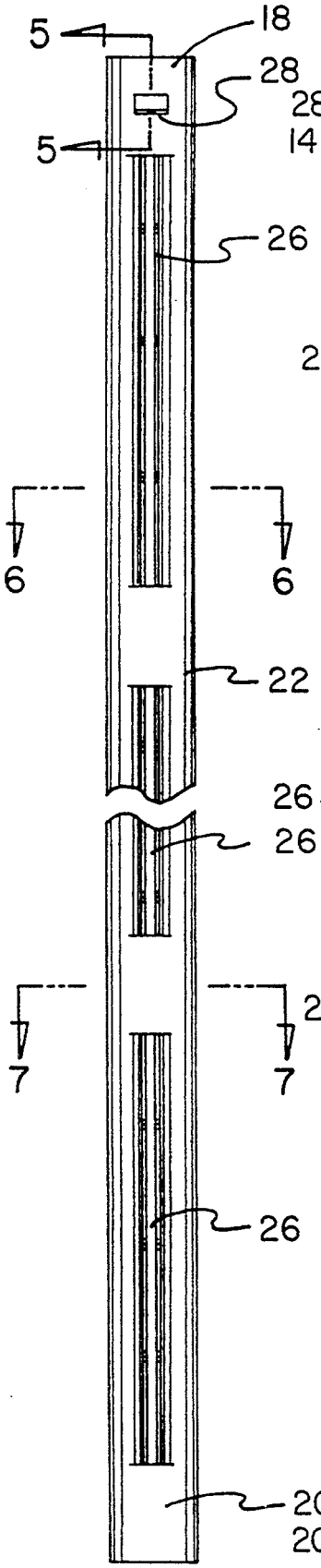
FIG. 3 is a plan view of the securement portion of the present invention.
Figure 4:
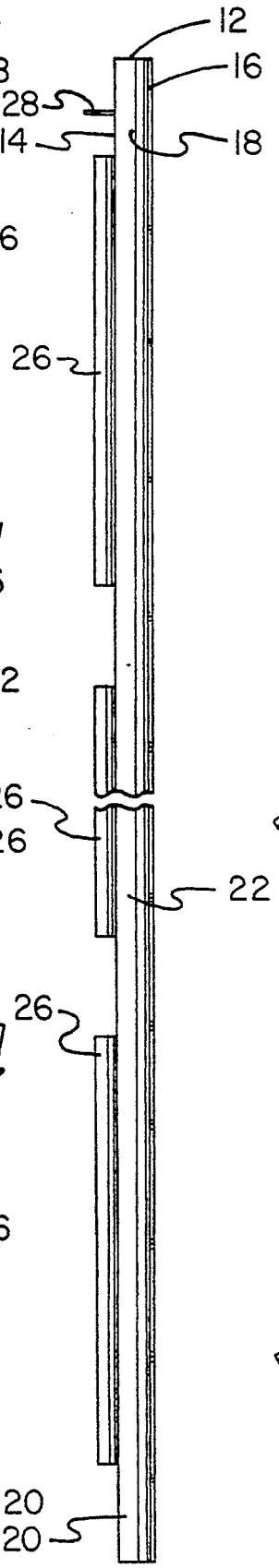
FIG. 4 is a side elevated view of the securement portion of the present invention.
Figure 5:
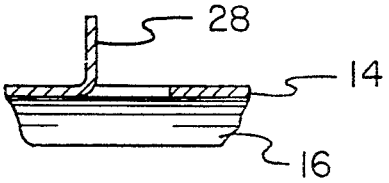
FIG. 5 is a cross-sectional view taken along line 5—5 of FIG. 3.
Figure 6:
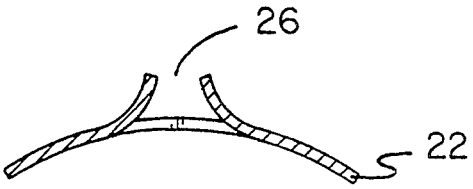
FIG. 6 is a cross-sectional view taken along line 6—6 of FIG. 3.
Figure 7:
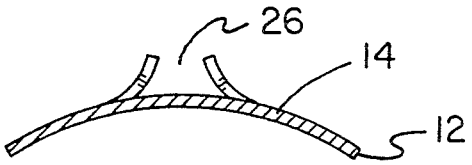
FIG. 7 is a cross-sectional view taken along line 7—7 of FIG. 3.
Figure 12:
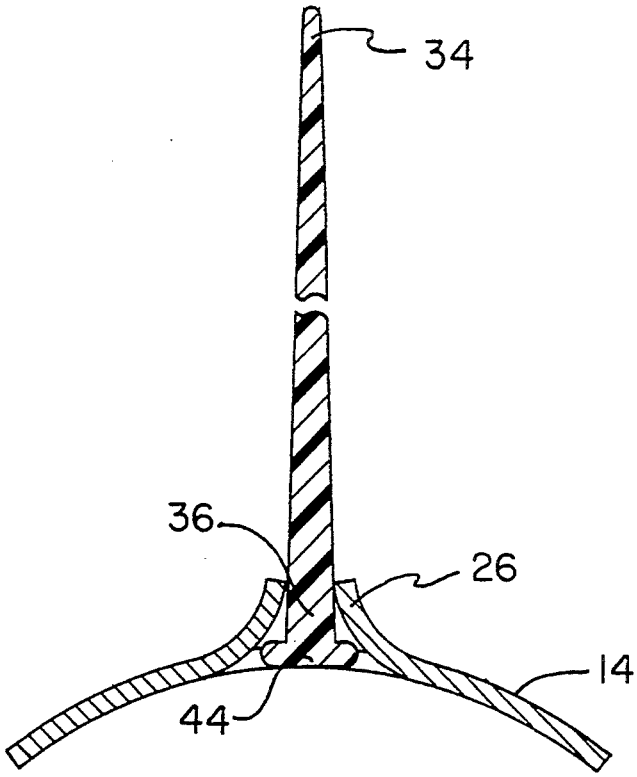
FIG. 12 is a sectional view of the coupling of the fletch portion to the securement portion.
Figure 13:
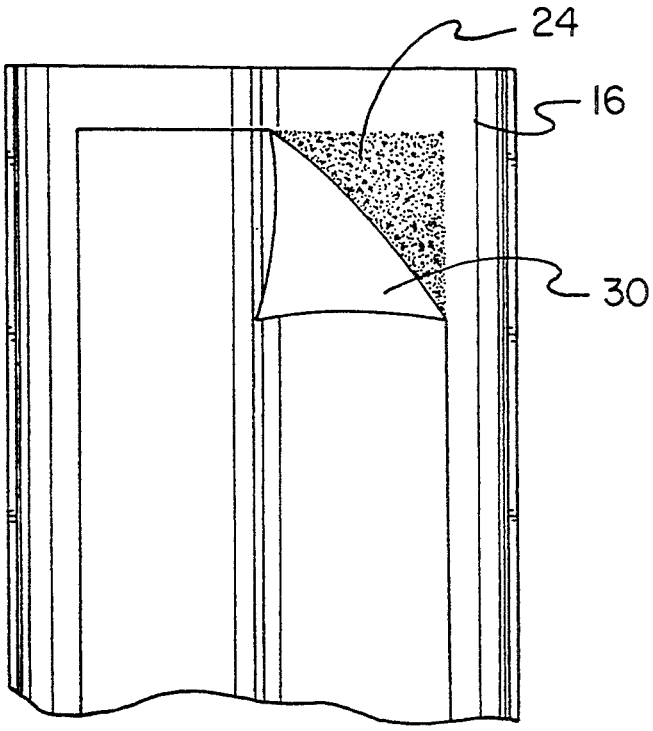
FIG. 13 is a plan sectional view of the adhesive feature of the present invention.

With reference now to the drawings, and in particular, to FIG. 1 thereof, the preferred embodiment of the new and improved fletch replacement device embodying the principles and concepts of the present invention and generally designated by the reference number 10 will be described.

Specifically, it will be noted in the various Figures that the device relates to a new and improved fletch replacement device for changing or replacing fletches on arrows quickly and easily. In its broadest context, the device consists of a securement portion, an adhesive cover, and a fletch portion.

The device 10 contains a securement portion 12 having an upper surface 14, a lower surface 16, a first end 18, a second end 20, and an intermediate extent 22 therebetween. The securement portion 12 is preferably constructed of metal. The lower surface 16 has an adhesive surface 24 thereon. The adhesive surface 24 is adapted to be coupled with an upper end of a shaft of the arrow. The adhesive surface 24 provides a very strong bond between the securement portion 12 and the shaft that could be construed as permanent, but could be removed if necessary. The upper surface 14 of the first end 18 has a slot 26 integral therewith inwardly thereof. The upper surface 14 of the intermediate extent 22 has a slot 26 integral therewith. The upper surface 14 of the second end 20 has a slot 26 integral therewith inwardly thereof. The slot 26 of the first end 18 and the slot 26 of the second end 20 and the slot 26 of the intermediate extent 22 have a gap of about ¼ of an inch therebetween. The slots 26 are formed by punching up on the metal. A securement tab 28 is secured to the upper surface 14 inward of the first end 18. Although the securement portions 12 are constructed to be secured to existing arrow shafts, construction of new arrows can be made with the securement portion 12 being integral with the shaft.

The device 10 contains an adhesive cover 30. The adhesive cover 30 is removably secured to the adhesive surface 24 of the securement portion 12. The adhesive cover 30 serves to protect the adhesive surface 24 before being coupled with the upper end of the shaft of the arrow.

The device 10 contains a fletch portion 32 having an upper surface 34, a lower surface 36, a first end 38, a second end 40, and an intermediate extent 42 therebetween. The lower surface 36 of the first end 38 has a flange 44 integral therewith. The lower surface 36 of the second end 40 has a flange 44 integral therewith. The lower surface 36 of the intermediate extent 42 has a flange 44 integral therewith. The flange 44 of the first end 38 is slidably coupled with the slot 26 of the second end 20 of the securement portion 12. The flange 44 of the second end 40 is slidably coupled with the slot 26 of the first end 18 of the securement portion 12. The flange 44 of the intermediate extent 42 is slidably coupled with the slot 26 of the intermediate extent 22 of the securement portion 12. The fletch portion 32 is prevented from sliding out of the securement portion 12 by the securement tab 28.

The present invention is a technique which makes the changing or replacement of fletches on arrows very simple.

The easier replacement is made possible by adding tracks or guides to the shafts, held in place by adhesives. Each is about 4½ inches long, 3/32 inches wide and made of metal which is attracted to magnets. Three slots, about 3/32 inches in width and 1 1/5 inches in length are pushed through the longitudinal center of the material, with the sides tapered so they form a slot which is only 1/16 inches wide at the top. Gaps of ¼ inch in length are provided between the slots for strength. The fletch which fits into the slotted track is made of plastic and is 1/16 inches in thickness, with a flange along the bottom that fits snugly in the wider portion of the slots. Dabs of adhesive are added to keep it in place until it is to be changed.

Two, three, or four T-slot guides are placed on the arrow shaft, equally spaced radially to hold the vane-shaped fletches. The adhesive will hold them in place through countless changes of fletches, but they can be forced off if necessary.

Since refletching is currently very expensive because they must be unglued and reglued, this invention is both a time and cost saving arrangement. Existing arrows can be modified to incorporate this design, and new units can include this feature.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved fletch replacement device for changing or replacing fletches on arrows quickly and easily comprising, in combination:

a securement portion having an upper surface, a lower surface, a first end, a second end, and an intermediate extent therebetween, the lower surface having an adhesive surface thereon, the adhesive surface adapted to be coupled with an upper end of a shaft of the arrow, the upper surface of the first end having a slot integral therewith inwardly thereof, the upper surface of the intermediate extent having a slot integral therewith, the upper surface of the second end having a slot integral therewith inwardly thereof, the slot of the first end and the slot of the second end and the slot of the intermediate extent having a gap of about ¼ of an inch therebetween, a securement tab secured to the upper surface inward of the first end;

an adhesive cover, the adhesive cover removably secured to the adhesive surface of the securement portion, the adhesive cover serving to protect the adhesive surface before coupled with the upper end of the shaft of the arrow;

a fletch portion having an upper surface, a lower surface, a first end, a second end, and an intermediate extent therebetween, the lower surface of the first end having a flange integral therewith, the lower surface of the second end having a flange integral therewith, the lower surface of the intermediate extent having a flange integral therewith, the flange of the first end slidably coupled with the slot of the second end of the securement portion, the flange of the second end slidably coupled with the slot of the first end of the securement portion, the flange of the intermediate extent slidably coupled with the slot of the intermediate extent of the securement portion, the fletch portion prevented from sliding out of the securement portion by the securement tab.

2. A fletch replacement device for changing or replacing fletches on arrows quickly and easily comprising, in combination:

a securement portion having an adhesive surface thereon, the adhesive surface adapted to be coupled with an upper end of a shaft of the arrow, the securement portion having a plurality of slots integral therewith, the plurality of slots having a gap of about ¼ of an inch therebetween;

a fletch portion having a flange integral therewith, the flange slidably coupled with the plurality of slots of the securement portion.

3. The device as described in claim 2 and further including wherein a securement tab is secured to the an end portion of the securement portion, the securement tab preventing the fletch portion from sliding out of the securement portion.

4. The device as described in claim 3 and further including wherein an adhesive cover removably secured to the adhesive surface of the securement portion, the adhesive cover serving to protect the adhesive surface before being coupled with the upper end of the shaft of the arrow.

* * * * *